US011304439B2

(12) United States Patent
Conrady et al.

(10) Patent No.: US 11,304,439 B2
(45) Date of Patent: Apr. 19, 2022

(54) METHOD AND APPARATUS TO FOLD A SHEET OF MATERIAL INTO A ROD FOR AN AEROSOL GENERATING ARTICLE

(71) Applicant: PHILIP MORRIS PRODUCTS S.A., Neuchatel (CH)

(72) Inventors: Jonas Conrady, Hamburg (DE); Rainer Dangers, Hamburg (DE); Peter Reuschel, Havekost (DE); Frank Syrzisko, Glinde (DE)

(73) Assignee: Philip Morris Products S.A., Neuchatel (CH)

( * ) Notice: Subject to any disclaimer, the term of this patent is extended or adjusted under 35 U.S.C. 154(b) by 214 days.

(21) Appl. No.: 16/613,154

(22) PCT Filed: May 18, 2018

(86) PCT No.: PCT/EP2018/063218
§ 371 (c)(1),
(2) Date: Nov. 13, 2019

(87) PCT Pub. No.: WO2018/211117
PCT Pub. Date: Nov. 22, 2018

(65) Prior Publication Data

US 2020/0138093 A1 May 7, 2020

(30) Foreign Application Priority Data

May 18, 2017 (EP) ..... 17171828

(51) Int. Cl.
*A24C 5/18* (2006.01)
*A24D 3/02* (2006.01)
(Continued)

(52) U.S. Cl.
CPC ..... *A24C 5/18* (2013.01); *A24D 3/0204* (2013.01); *A24B 3/14* (2013.01); *A24B 15/16* (2013.01); *A24D 3/0229* (2013.01); *A24D 3/0279* (2013.01)

(58) Field of Classification Search
CPC ..... A24C 5/18; A24D 3/0204; A24B 3/14; A24B 15/16
See application file for complete search history.

(56) References Cited

U.S. PATENT DOCUMENTS

| | | | |
|---|---|---|---|
| 2,001,709 | A | 5/1935 | Davidson |
| 3,818,809 | A | 6/1974 | Sylvester |
| 4,047,536 | A | 9/1977 | Asfour |

FOREIGN PATENT DOCUMENTS

| | | |
|---|---|---|
| GB | 958329 | 5/1964 |
| WO | WO 00/51451 | 9/2000 |

(Continued)

OTHER PUBLICATIONS

PCT Search Report and Written Opinion for PCT/EP2018/063218 dated Jun. 28, 2018 (12 pages).

(Continued)

*Primary Examiner* — Eric Yaary
*Assistant Examiner* — Jennifer A Kessie
(74) *Attorney, Agent, or Firm* — Mueting Raasch Group

(57) ABSTRACT

The present invention relates to a method to fold a sheet (11) of material into a rod for an aerosol generating article, the method comprising: providing a central element and plurality of spaced apart walls (14), the spaced apart walls radially extending outwardly from the central element (12) following one another in a circumferential direction, each spaced apart wall defining an end surface (15) separated from the end surfaces of the adjacent walls; transporting the sheet of material and putting it in contact with the end surfaces of the plurality of spaced apart walls so that the sheet of material (Continued)

can partly fold within spaces defined between the spaced apart walls; and inserting the sheet of material into a funnel (16) to form a rod. The present invention also relates to an apparatus (10) to fold a sheet of material into a rod for an aerosol generating article.

6 Claims, 3 Drawing Sheets

(51) Int. Cl.
*A24B 3/14* (2006.01)
*A24B 15/16* (2020.01)

(56) References Cited

FOREIGN PATENT DOCUMENTS

| | | |
|---|---|---|
| WO | WO 2015/028644 | 3/2015 |
| WO | WO 2016/023965 | 2/2016 |

OTHER PUBLICATIONS

International Preliminary Report on Patentability for PCT/EP2018/063218 dated May 8, 2019 (11 pages).

METHOD AND APPARATUS TO FOLD A SHEET OF MATERIAL INTO A ROD FOR AN AEROSOL GENERATING ARTICLE

This application is a U.S. National Stage Application of International Application No. PCT/EP2018/063218 filed May 18, 2018, which was published in English on Nov. 22, 2018 as International Publication No. WO 2018/211117 A1. International Application No. PCT/EP2018/063218 claims priority to European Application No. 17171828.1 filed May 18, 2017.

The present invention is related to a method to fold a sheet of material into a rod for an aerosol generating article. The present invention also is related to an apparatus to fold a sheet of material into a rod for an aerosol generating article. Such material forming the sheet could include a homogenized tobacco material, TCL (Tobacco Cast Leaf), which is dried, and then cut in foils or sheets which are winded up into bobbins for storage and transport. Other materials could include for instance PLA (Poly Lactic Acid) which is used to manufacture specific part of aerosol generating articles' filters.

In some manufacturing process of the aerosol generating articles, the sheet of material needs to be folded, so that its shape goes from flat to tubular. In order to compress the sheet and to fold into a rod, usually the sheet is being pulled through a funnel.

The so-formed rod is then cut into parts, called "sticks". These sticks may be used as components of the aerosol generating article.

The way the material sheet is compressed or fold into a rod may affect different properties of the aerosol generating article. However, the way the sheet is compressed or fold may be quite random as resulting from the sheet of material being pulled at high speed into a funnel.

Consequently, some of the key parameters of the aerosol generating articles, for instance the RTD level (Resistance To Draw), may vary.

It would be desirable to have a system that increases the consistency of the way the sheet is being compressed or folded into a rod.

In particular, there is a need of a method and apparatus to fold a sheet of material into a rod for an aerosol generating article, wherein said method and apparatus allow obtaining a more homogeneous rod for an aerosol generating article, having reduced standard deviations of the key parameters of the aerosol generating article.

In a first aspect, the invention relates to a method to fold a sheet of material into a rod for an aerosol generating article, the method comprising: providing a central element and plurality of spaced apart walls, the spaced apart walls radially extending outwardly from the central element and following one another in a circumferential direction, each spaced apart wall defining an end surface separated from the end surfaces of the adjacent walls; transporting the sheet of material and putting it in contact with the top surfaces of the plurality of spaced apart walls so that the sheet of material can partly folds within spaces defined between the spaced apart walls; and inserting the sheet of material into a funnel to form a rod.

The invention substantially includes a preparatory step before a folding or compressing step to change shape of the sheet of material from flat to tubular. Advantageously, according to the method of the invention, the sheet of material is put into contact with a device having a plurality of separated walls which define end surfaces. The sheet of material may partly fold within the empty spaces formed between the walls before being inserted into a funnel for obtaining a final rod shape. The empty spaces are located substantially along the transport direction of the sheet. In this way, a homogeneous rod, having preferably reduced standard deviations of the key parameters to be used in an aerosol generating article, is obtained.

As used herein, the term "sheet" denotes a laminar element having a width and length substantially greater than the thickness thereof. The width of a sheet is preferably greater than about 10 millimeters, more preferably greater than about 20 millimeters or about 30 millimeters. Even more preferably, the width of the sheet is comprised between about 100 millimeters and about 300 millimeters.

In a preferred embodiment, the sheet is a sheet of a material containing alkaloids, for example homogenized tobacco material. Other plant-based material containing alkaloids can be used as well. Polymeric material sheets are also possible sheets to be deformed into rods.

A "material containing alkaloids" is a material which contains one or more alkaloids. Among alkaloids, nicotine is a preferred one, which can be found in tobacco. Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

The most commonly used forms of homogenized tobacco material is reconstituted tobacco sheet and cast leaf. The process to form homogenized tobacco material sheets commonly comprises a step in which tobacco dust and a binder, are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making.

The sheet material of tobacco can be referred to as a reconstituted sheet material and formed using particulate tobacco (for example, reconstituted tobacco) or a tobacco particulate blend, a humectant and an aqueous solvent to form the tobacco composition. This tobacco composition is then casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The sheet of homogenized tobacco material may be rolled in bobbins which are unwound in order to be further processed, to be part for example of an aerosol generating article, that is to be included in the aerosol-forming substrate of the aerosol generating article. A "heat-not-burn" aerosol generating article is a smoking article wherein an aerosol-forming substrate, such the homogenized tobacco sheet, is heated to a relatively low temperature, in order to form an aerosol but prevent combustion of the tobacco material. Further, the tobacco present in the homogenized tobacco sheet is typically the only tobacco, or includes the majority of the tobacco, present in the homogenized tobacco material of such a "heat-not-burn" aerosol generating article. This means that the aerosol composition that is generated by such a "heat-not-burn" aerosol generating article is substantially only based on the homogenized tobacco material.

As used herein, the term "aerosol forming material" denotes a material that is capable of releasing volatile compounds upon heating to generate an aerosol. Tobacco may be classed as an aerosol forming material, particularly a sheet of homogenized tobacco comprising an aerosol former. An aerosol forming substrate may comprise or consist of an aerosol forming material.

The homogenized tobacco sheet generally includes, in addition to the tobacco, a binder and an aerosol-former. This composition leads to a sheet which may be "sticky", that is, it glues to adjacent objects, and at the same time it is rather fragile having a relatively low tensile strength. The homogenized tobacco sheet can thus be used as an aerosol forming material.

The invention relates to a preparatory step to "prepare" the sheets of material to a step in which they are folded into rods. In order to fold the sheet of material, which has a flat-like shape, into a rod like shape, a pre-step in which the sheet of material is put into contacts to a plurality of spaced apart walls is provided for.

A central element and plurality of spaced apart walls are provided. The walls are extending from the central element following one another in a circumferential direction.

The central element defines a longitudinal axis, which is used as the main reference axis for the elements that form part of the device of the present invention; all of the indications of directions and the like, such as "axial", "radial", and "circumferential" will refer to it; equally, the indications "outwards" and "inwards" referring to radial directions must be taken as away from the axis or towards the axis. Two opposite angular directions are also defined about the axis. In particular, an axial direction is a direction parallel to the central element axis; a radial direction is a direction laying on a plane perpendicular to the central element axis and incident to the central element axis; a circumferential direction is a direction along a circumference centered on the central element axis and laying on a plane perpendicular to the central element axis.

The spaced apart walls extend from the central element, and then are distributed circumferentially, so that for each couple of adjacent spaced apart walls an angle is formed. Preferably, the angle is different from zero.

The angle different from zero which separates the wall one from the others defines preferably "empty spaces" between each couple of adjacent walls. Each wall includes a first and a second end, opposed to each other. To one of the end, an end surface is defined. Preferably, the end surface is the outer surface with respect to the central element axis. The other end of each wall not having the end surface is preferably connected to the central element.

In addition to the end surface, preferably each wall includes two major surfaces parallel to each other, which are substantially planar. Preferably, the end surface is perpendicular to the two major surfaces.

Preferably, the central element is positioned substantially parallel to the direction in which the sheet is transported.

The end surface may enter into contact with the sheet of material to be pre-treated. The sheet of material, which is not rigid but preferably flexible, coming into contact with the end surfaces which are separated one from the others by "empty gaps or spaces", is prone to change its shape from a flat one to a wavy one. The sheet of material may folds so that it partially enters into the empty spaces formed among the walls. Indeed the "empty spaces" are substantially located parallel to the direction of motion of the sheet, so that the sheet can enter into them at least partly. After this partially folding step, the sheet may undergo the complete folding-into-a-rod step. This latter step may include the presence of a funnel-shaped device.

The pre-step in which the sheet at least partially folds in spaces formed between each couple of adjacent walls allows a better control of the final folding step in which the sheet of material is folded into a rod.

Preferably, providing a plurality of spaced apart walls includes providing spaced apart walls having a dimension which decreases moving towards the funnel. The dimension is the distance between the two ends of the wall. Therefore, the distance between the substrate and the end of the wall, where the end surface is present, decreases moving towards the funnel. With reference to the central element axis, the radial dimension of the walls decreases moving along the axial direction towards the funnel. The sheet of material is generally moved at high speed. Therefore, it is put into contact with the upper surfaces of the walls also at high speed. In order to gradually fold the sheet from the flat-like shape to a rod shape, the dimension of the walls decreases from the first point of contact between the sheet and the walls to the last point of contact where the sheet leaves the walls. In this way, the sheet experiences a gradual folding into itself because the overall volume that can occupy inside the spaces between the walls decreases. A gentle folding may be thus achieved. Advantageously, in this way the sheet of material folds more and more as it moves towards the funnel.

Preferably, providing a plurality of spaced apart walls includes providing spaced apart walls having a size of the end surface in a direction perpendicular to a direction of transport of the sheet which is increasing moving towards the funnel. The size of the end surface, that is, the width of the end surface, increases moving towards the funnel. Preferably, the thickness of the whole wall increases moving towards the funnel. Advantageously, in this way, the "free" space which is present between two adjacent walls decreases more and more as the sheet of material moves towards the funnel. The folding of the sheet thus gradually increases.

Preferably, the method according to the present invention includes the step of crimping the sheet of material before transporting the sheet of material and putting it in contact with the end surfaces of the plurality of walls. Advantageously, the step of crimping increases the homogeneity of the obtained rod for an aerosol generating article. Generally, in order to form an aerosol generating article, the sheet of material needs to be crimped before the folding into a rod step. The crimping may be performed by crimping rollers which form ridges or grooves in the sheet of material.

Preferably, the method according to the present invention includes the step of folding the sheet of material into a tubular shape. The shape may be cylindrical or conical. Even before the compression into a rod, the sheet may be pre-folded in a cylindrical or funnel shape having a diameter bigger than the final rod, in order to prepare the sheet to the final compression and folding step. The folding may be performed by means of a cylindrical or conical surface.

More preferably, providing a plurality of spaced apart walls includes providing a plurality of walls radially extending from a central element. Advantageously, the cylindrical or conical surface and the plurality of walls radially extending from a central element allow performing the method in a compact space.

Preferably, the sheet of material is a polymeric sheet or a sheet of material including alkaloids. More preferably, the sheet is a sheet of homogenized tobacco material.

In a second aspect, the invention relates to an apparatus to fold a sheet of material into a rod for an aerosol generating article, the apparatus comprising: a central element and a plurality of spaced apart walls, the spaced apart walls extending from the central element following one another in a circumferential direction, each wall of the plurality defining an end surface separated from the end surfaces of the adjacent walls; and a funnel positioned downstream the central element, the entrance of the funnel facing the central element.

Advantageously, the apparatus according to the invention is suitable to perform the method of the invention, with the advantages mentioned above. This apparatus is also extremely compact.

Preferably, the spaced apart walls have a dimension which is decreasing moving towards the funnel. This dimension is the radial extension of the walls. Advantageously, in this way the sheet of material folds more and more as it moves towards the funnel. The folding is therefore "gentle".

Preferably, the thickness of the walls is variable. Preferably, the thickness increases along the axial direction.

Preferably, the spaced apart walls have a size of the end surface in a direction perpendicular to a direction of transport of the sheet which is increasing moving towards the funnel. Advantageously, in this way the "free space" between two adjacent walls decreases more and more as the sheet of material moves towards the funnel, already pre-compressing some portions of the sheet. Preferably, the size of the whole wall increases, that is, the thickness of the wall increases moving towards the funnel.

Preferably, the funnel and the central element are substantially coaxial. More preferably, a tangent to the internal surface of the funnel substantially coincides with a tangent to the end surface of a spaced apart wall of the plurality. Advantageously, with this layout, the sheet is substantially moving in contact with a "continuous" converging surface, formed in a first part by the end surfaces of the walls and then by the funnel. The sheet of material is easily inserted into the funnel due to the conical shape given by the walls, conical shape that decreases in diameter in the funnel.

Preferably, the apparatus according to the present invention includes a conical element positioned on a side of the central element opposite to the funnel. The conical element is preferably frustoconical (has the shape of a frustum of a cone). More preferably, the conical element has a diameter which increases towards the central element. Even more preferably, the conical element and the funnel are substantially coaxial. This arrangement still improves the compression and folding of the sheet in a gentle manner. The sheet "experiences" a surface which is increasing in size towards the funnel where it is finally compressed and folded to form the rod.

Further advantages of the invention will become apparent from the detailed description thereof with no-limiting reference to the appended drawings.

Figure 1:
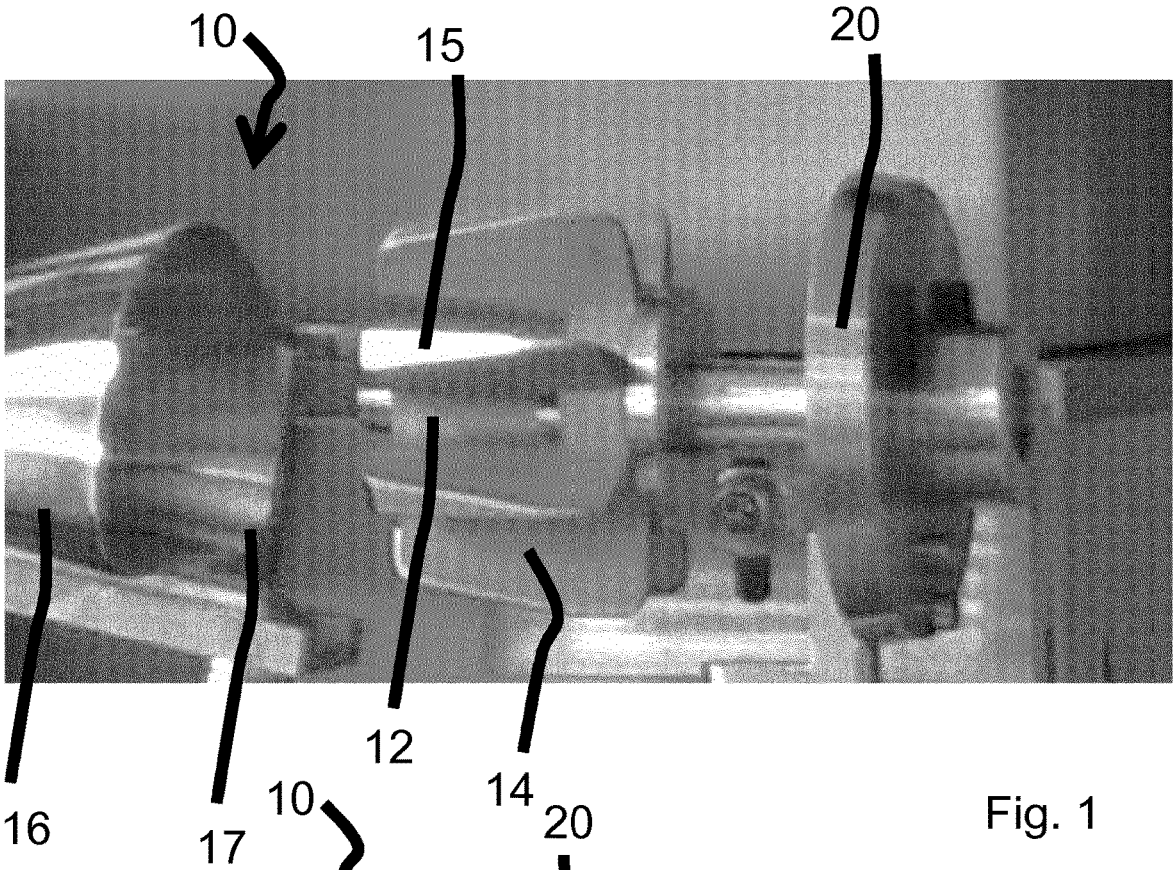
FIGS. 1-3 are schematic perspective views of an apparatus to fold a sheet of material into a rod for an aerosol generating according to the invention.

With reference to the figures, an apparatus according to the present invention is represented and indicated with reference number 10, the apparatus 10 being suitable to fold a sheet 11 of material (visible in FIGS. 4-6) into a rod for an aerosol generating article (rod and aerosol generating article are not shown in the appended drawings). Preferably the sheet 11 of material is a polymeric sheet or a sheet including homogenized tobacco material.

In the preferred embodiments shown in FIGS. 1-4, the sheet 11 travels from the right to the left.

The apparatus 10 comprises a central element 12 with a plurality of spaced apart walls or fins 14 extending from the central element 12 circumferentially. The central element 12 and fins 14 defines substantially a star-shaped object. Central element 12 extends along a longitudinal axis 2 of the central element (see FIG. 3) from which the fins 14 depart.

Further, apparatus 10 includes a funnel 16 positioned downstream the central element 12 in the direction of motion of the sheet 11 of material. Funnel 16 defines also a longitudinal axis, which substantially coincides with longitudinal axis 2 of central element 12. Funnel 16 is known in the art to produce rods of material for aerosol generating articles and not further described in detail.

Funnel 16 includes an inlet or entrance 17 for the sheet 11. At the inlet, funnel has the widest cross-section. The entrance 17 of the funnel 16 faces the central element 12, perpendicularly to the axis 2.

The funnel 16 and the central element 12 are substantially coaxial.

Figure 2:
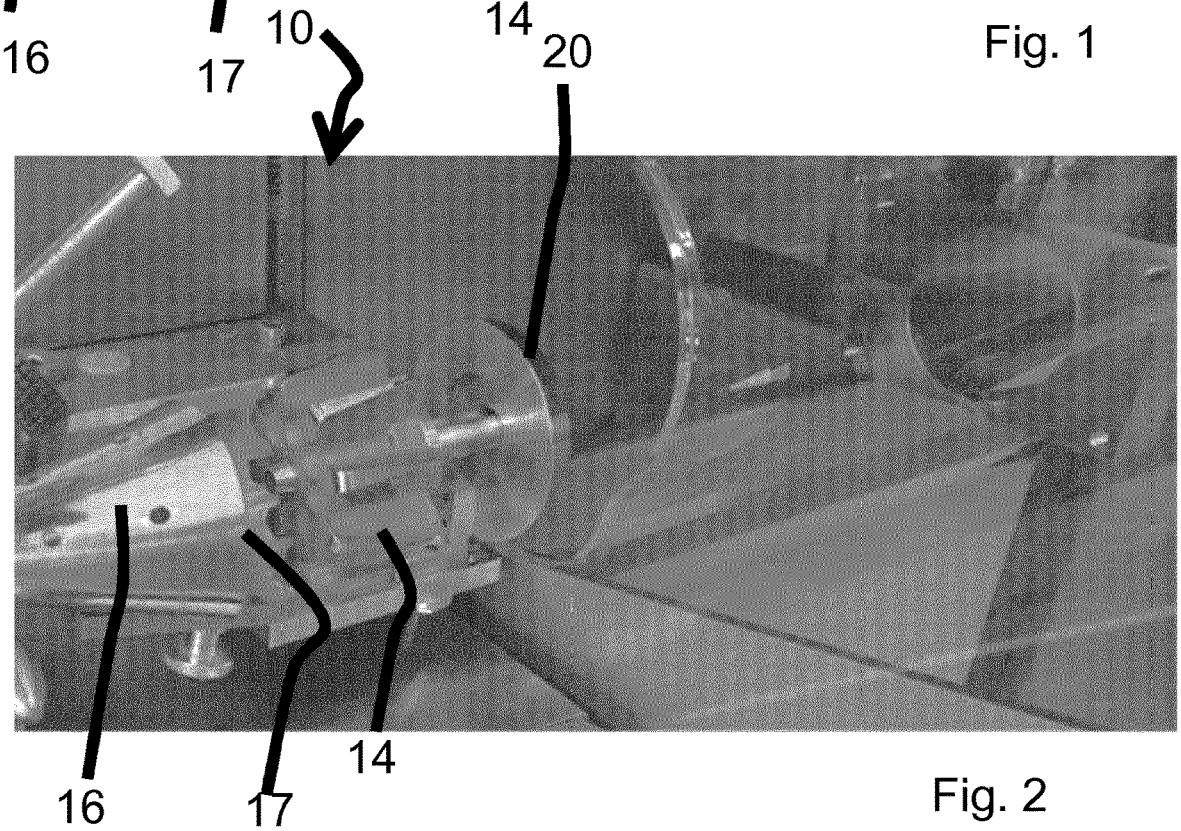
Figure 3:
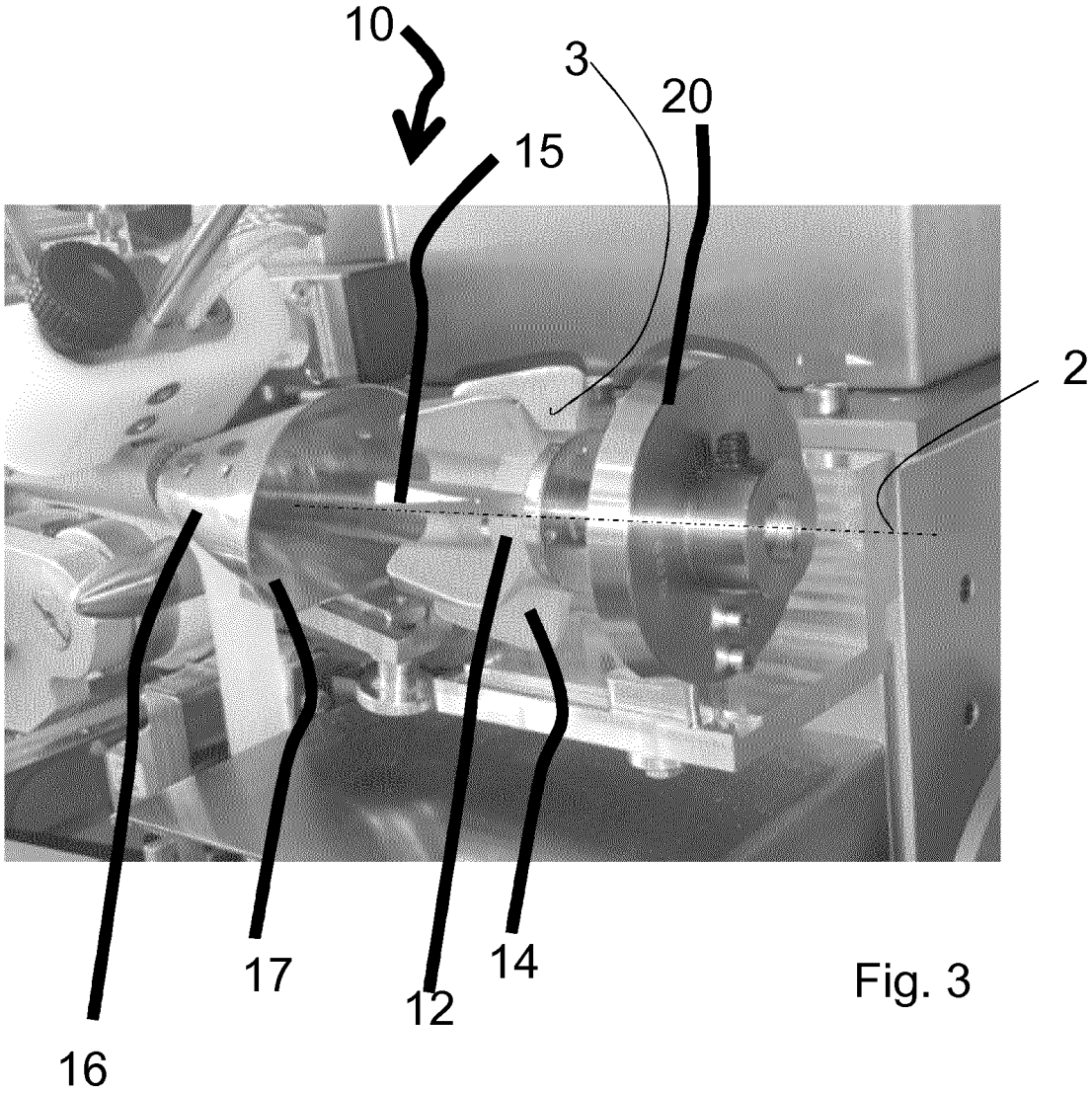
Figure 4:
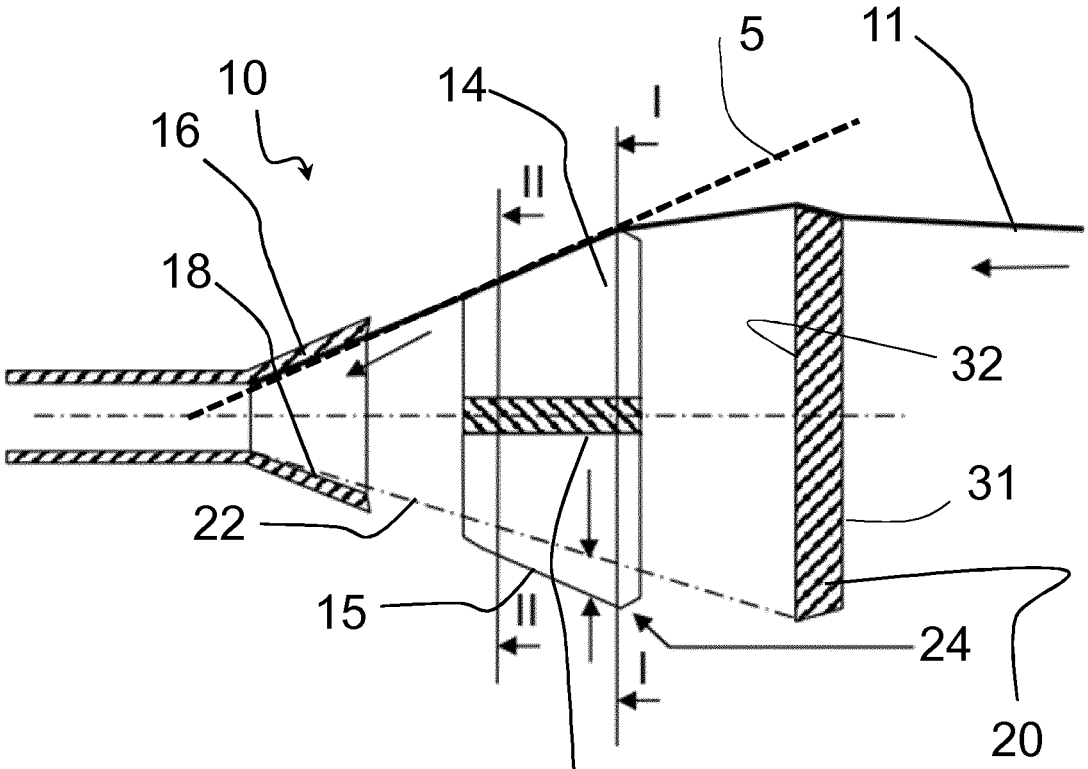
FIG. 4 is a schematic lateral section of another embodiment of the apparatus to fold a sheet of material into a rod for an aerosol generating according to the invention.
Figure 6:
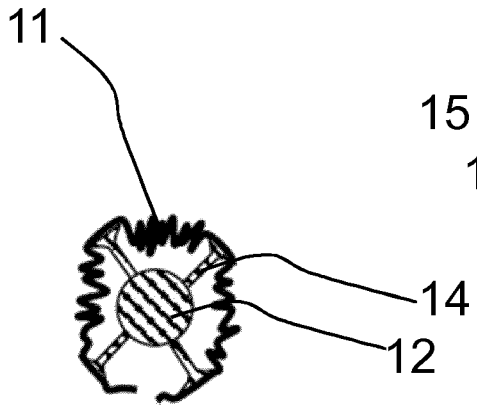
FIG. 6 is a schematic cross section of the apparatus of FIG. 4, taken in the plane indicated with I-I in FIG. 4.
Figure 5:
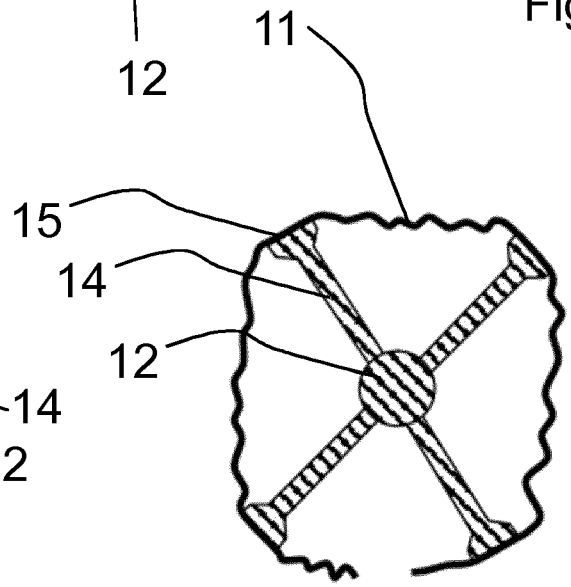
FIG. 5 is a schematic cross section of the apparatus of FIG. 4, taken in the plane indicated with II-II in FIG. 4.

In the embodiment shown in FIGS. 1-3 there are eight spaced apart walls 14, whereas in the embodiment shown in FIGS. 4-6 there are four spaced apart walls 14. In a further preferred embodiment not shown there are ten spaced apart walls 14.

The spaced apart walls 14 have a dimension which is decreasing moving towards the funnel 16. The dimension is the dimension along the radial direction of the wall, calculated in the following: the decreasing dimension is the distance perpendicularly to the axis 2 between the axis itself and the endmost point of the wall 14. This distance decreases from the beginning of the central element till the end of the central element facing funnel 16.

Each wall 14 defines an end surface 15 separated from the end surfaces 15 of the adjacent walls 14. End surfaces of adjacent walls do not touch. In this way, between two adjacent spaced-apart walls, an "empty space" 3 is defined.

The spaced apart walls 14 have a size of the end surface 15 taken in a direction perpendicular to a direction of transport of the sheet 11 which is increasing moving towards the funnel 16. This can be clearly seen for example in FIG. 1.

The walls 14 are thinner on the point where the sheet 11 meets the apparatus 10, and become broader after.

As shown in FIG. 4, a tangent 5 to the internal surface 18 of the funnel 16 substantially coincides with a tangent to the end surface 15 of a spaced apart wall 14. The tangent 5 is represented with a dotted line passing through the end surface 15 and internal surface 18 of the funnel.

The apparatus 10 further comprises a conical element 20 positioned on a side of the central element 12 opposite to the funnel 16. Conical element is positioned with a basis of the cone substantially perpendicular to longitudinal axis 2.

The conical element 20 has a diameter which increases towards the central element 12.

The conical element 20 and the funnel 16 are substantially coaxial (see FIG. 4), so that the axis of the conical element is also longitudinal axis 2. Conical element 20 is preferably a truncated cone and defines two opposite bases 31, 32 which are preferably perpendicular to the longitudinal axis 2.

With reference to the operation of the apparatus 10, the end surfaces 15 of the spaced apart walls 14 create contact lines on an incoming sheet 11 which is forced to fold into a tubular shape. The travelling direction of the sheet 11 is along the longitudinal axis 2 towards the funnel.

These contact lines form a "virtual" right circular frustum of a cone having a decreasing diameter along the direction into which the sheet 11 is pulled, that is, along the longitudinal axis 2 towards the funnel 16.

The empty spaces 3 defined between the end surfaces 15 of the walls 14 in contact with the sheet 11 force the sheet 11 to fold in a quite controlled way between the walls 14 of the apparatus 10 (there is an even distribution of folds or corrugations forming in the empty spaces). This is due to the decrease in volume of the empty spaces along the longitudinal axis 2.

This folding occurring before the sheet 11 enters into the funnel 16 adds consistency and control to the way the sheet 11 folds on itself in the funnel 16. The sheet of material 11 therefore "experiences" the whole apparatus 10 as a truncated right circular cone which has a diameter which decreases along the direction of travel of the sheet 11, which coincides with the longitudinal axis 2. The sheet 11 before entering the funnel has already a folded conical shape.

This is further enhanced by the presence of the conical element 20. This conical element meets the incoming sheet 11 before the walls 14, which is the first element contacted by the sheet 11.

As shown in FIGS. 4-6, a cone can be formed considering an enveloping surface connecting the end surfaces 15 of all spaced apart walls 14. With this enveloping surface, a truncated cone is formed (see FIG. 4). The truncated cone defined by the conical element 20 and the truncated cone formed by the enveloping surface have the same axis 2. This axis is in the center axis of the tubular shape of the incoming sheet 11.

The base 32 of the conical element 20 has a diameter equivalent to or larger than the diameter of the enveloping surface at its "virtual" base facing base 32, so that the incoming sheet 11 which is in tubular shape has, when leaving the conical element 20, an equivalent diameter than the enveloping surface.

In this way, the sheet 11 is forced to enter in contact with the walls 14 with a slight slope, while preventing the sheet 11 to be damaged when entering in contact, at high speed, with the small end surfaces 15 of the walls 14.

In FIG. 4, a straight line is drawn connecting the inner surface 18 of funnel 16 and base 32. It is shown that the walls extend beyond the straight line 22: for this reason contact is ensured contact between sheet 11 and the walls 14.

The walls 14 are provided at the end surfaces 15 with a bevel 24, which allows avoiding shredding of the incoming sheet 11.

In FIG. 5 folds of the sheet 11 are shown, which are formed and kept between walls 14. The folds of the sheet are forced to remain between two adjacent walls because, as the sheet 11 is pulled, and the walls 14 are extends beyond straight line 22, the sheet is substantially "compressed" against the surfaces 15.

In FIG. 6 folds which are almost gathered are depicted, as space between walls 14 decreases. Almost the same quantity of folds in each space is achieved.

In further embodiments (not shown), in order to change the shape of the sheet 11 from planar to tubular, it is possible to use a suitable apparatus before the apparatus 10 according to the invention, which folds the sheet 11 into a tubular shape.

Furthermore, a mandrel (not shown) can be put in the center of the apparatus 10 in order to introduce specific components (flavour, material, etc.) in the center of the folded sheet 11.

In general, according to the invention, a method to fold a sheet 11 of material into a rod for an aerosol generating article comprises the steps of: providing the device above described having the plurality of spaced apart walls 14, each defining the end surface 15 separated by the end surfaces 15 of the adjacent walls 14; transporting the sheet 11 of material and putting it in contact with the end surfaces 15 of the plurality of walls 14 so that the sheet 11 can partly folds within the spaces between the walls 14; and inserting the sheet 11 into the funnel 16 to form the rod.

In other words, the method and apparatus 10 of the invention provide a series of spaced contacting edges (i.e. the end surfaces of the walls 14) contacting the sheet 11, and between these edges empty spaces are formed which give room for the folds of the sheet to freely arrange. The space between the contacting edges becomes narrower and narrower along the longitudinal axis 2 of the apparatus 10. In a non-depicted embodiment of the invention, the walls are parallel to each other, forming a plurality of parallel end surfaces.

The invention claimed is:

1. A method to fold a sheet of material into a rod for an aerosol generating article, the method comprising:

providing a central element and plurality of spaced apart walls, the spaced apart walls radially extending outwardly from the central element and following one another in a circumferential direction, each spaced apart wall defining an end surface separated from the end surfaces of the adjacent walls;

transporting the sheet of material and putting it in contact with the top surfaces of the plurality of spaced apart walls so that the sheet of material partly folds within spaces defined between the spaced apart walls; and inserting the sheet of material into a funnel to form a rod.

2. The method according to claim 1, wherein providing a plurality of spaced apart walls includes providing spaced apart walls having a dimension which decreases moving towards the funnel.

3. The method according to claim 1, wherein providing a plurality of spaced apart walls includes providing spaced apart walls having a size of the end surface in a direction perpendicular to a direction of transport of the sheet which is increasing moving towards the funnel.

4. The method according to claim 1, including the step of crimping the sheet of material before transporting the sheet of material and putting it in contact with the end surfaces of the plurality of walls.

5. The method according to claim 1, including the step of folding the sheet of material into a tubular shape.

6. Method according to claim 1, wherein the sheet of material is a polymeric sheet or a sheet of a material containing alkaloids.

* * * * *